US011351771B2

(12) United States Patent
Bumm et al.

(10) Patent No.: US 11,351,771 B2
(45) Date of Patent: Jun. 7, 2022

(54) METHOD FOR SEPARATING PRINTED PRODUCTS THAT ARE PRINTED TOGETHER ONTO A SHEET

(71) Applicant: KOENIG & BAUER AG, Würzburg (DE)

(72) Inventors: Florian Bumm, Kitzingen-Sickershausen (DE); Dragan Dragoz, Forel (CH); Thomas Pawelak, Kürnach (DE); Jens Sauer, Würzburg (DE); Johannes Schaede, Würzburg (DE); Julian Schubert, Karbach (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/419,734

(22) PCT Filed: Jun. 17, 2020

(86) PCT No.: PCT/EP2020/066742
§ 371 (c)(1),
(2) Date: Jun. 30, 2021

(87) PCT Pub. No.: WO2021/023421
PCT Pub. Date: Feb. 11, 2021

(65) Prior Publication Data

US 2022/0088916 A1 Mar. 24, 2022

(30) Foreign Application Priority Data

Aug. 8, 2019 (DE) ..... 10 2019 121 401.7

(51) Int. Cl.
*B41F 13/58* (2006.01)
*B41F 33/00* (2006.01)
*B41F 13/60* (2006.01)

(52) U.S. Cl.
CPC ..... *B41F 13/58* (2013.01); *B41F 13/60* (2013.01); *B41F 33/00* (2013.01)

(58) Field of Classification Search
CPC ..... B41F 13/58; B41F 13/60; B41F 33/00
See application file for complete search history.

(56) References Cited

U.S. PATENT DOCUMENTS 4,653,399 A 3/1987 Kuehfuss
6,112,658 A 9/2000 Gunther
(Continued)

FOREIGN PATENT DOCUMENTS

DE 102005012913 A1 10/2005
DE 102008054019 A1 5/2010
(Continued)

OTHER PUBLICATIONS

International Search Report of PCT/EP2020/066742 dated Oct. 2, 2020.

*Primary Examiner* — Peter J Macchiarolo
*Assistant Examiner* — John M Royston
(74) *Attorney, Agent, or Firm* — Mattingly & Malur, PC

(57) ABSTRACT

A method for separating printed products, that are printed together onto a sheet of printed products, is disclosed. The printed products are printed onto a sheet in a printing press and are separated in a cutting system by a cutting device. Each of these printed products has an identification feature that identifies its respective position on the sheet. The sheet becomes deformed as it passes through the printing press. The separated printed products, which are likewise deformed, as a result of the deformation of the sheet, are inspected, in a quality control device which is located downstream of the cutting system, for compliance with the tolerance, at least with regard to the respective length or width of the printed products. For each printed product that has been identified, in terms of its position, the quality control device detects information relating to an exceeding of the tolerance, at least for the length or width of the printed product, and transmits that information, assigning that information to the position identified on the sheet, to a control unit of the cutting system. Based on the information transmitted by the quality control device, for printed products that are arranged in the same position on the sheet, and which will subsequently be separated in the cutting system, the control unit of the cutting system adjusts the relevant sheet and the cutting device in their respective positions, relative to one another, in such a way that each of the printed products to be separated complies with the respective tolerance. Compliance with the tolerance is achieved in that the position of the sheet and of the cutting device to be adjusted (Continued)

relative to one another is calculated in the control unit using a mathematical optimization method. The sheet is placed on a cutting table in the cutting system. The control unit of the cutting system adjusts the position of the sheet relative to the cutting device, according to the calculated position.

15 Claims, 3 Drawing Sheets

(56) References Cited

U.S. PATENT DOCUMENTS

| | | | | |
|---|---|---|---|---|
| 6,684,787 | B1 | 2/2004 | Sauer | |
| 6,901,855 | B2 | 6/2005 | Sauer et al. | |
| 2004/0020384 | A1 | 2/2004 | Sauer et al. | |
| 2012/0224227 | A1* | 9/2012 | Kukino | H04N 1/387 358/3.06 |
| 2018/0193964 | A1* | 7/2018 | Joos | B23K 37/0408 |

FOREIGN PATENT DOCUMENTS

| | | | | |
|---|---|---|---|---|
| DE | 102012017636 | A1 | | 11/2013 |
| IT | 20152764 | A1 | | 2/2017 |
| JP | 2008238504 | A | * | 10/2008 |
| WO | 2001/15091 | A2 | | 3/2001 |
| WO | 2002/048014 | A1 | | 6/2002 |
| WO | 2003/082574 | A1 | | 10/2003 |
| WO | 2017/021886 | A1 | | 2/2017 |

* cited by examiner

METHOD FOR SEPARATING PRINTED PRODUCTS THAT ARE PRINTED TOGETHER ONTO A SHEET

CROSS-REFERENCE TO RELATED APPLICATION

This application is the US national phase, under 35 USC, § 371, of PCT/EP2020/066742, filed Jun. 17, 2020; published as WO 2021/023421 A1 on Feb. 11, 2021, and claiming priority to DE 10 2019 121 401.7, filed Aug. 8, 2019, the disclosures of which are expressly incorporated herein in their entireties by reference.

FIELD OF THE INVENTION

The present invention relates to a method for separating printed products that are printed together onto a sheet. The printed products that are printed together onto the sheet in a printing press are separated by a cutting device in a cutting system which is located downstream of the printing press. Each of these printed products has an identification feature that identifies its respective position on the sheet. The unprinted sheet is rectangular in shape and becomes deformed as it passes through the printing press. The separated printed products which are likewise deformed as a result of the deformation of the sheet, are inspected in a quality control device which is located downstream of the cutting system for compliance with the permissible preset tolerance, at least with regard to the respective length or width of the printed products.

BACKGROUND OF THE INVENTION

From DE 10 2008 054 019 A1, a method is known for adjusting the cutting register of a web-fed rotary printing press that comprises at least one printing couple and at least one downstream cross-cutting device, wherein at least one web of printing substrate is guided along a web path established for the respective production process from the printing couple to the cross-cutting device, where it is cross-cut; wherein the actual position of this cutting is determined by a motif, the actual cutting position is compared with a reference cutting position, and the cutting register can be adjusted based on a position deviation thus determined; and wherein to enable determination of the actual cutting position by means of at least one sensor, which is located a remaining distance upstream of the cross-cutting device in the web path, position information that describes the position of the cut relative to the motif is detected on the printing substrate web, cutting errors occurring in the remaining distance between the sensor and the cross-cutting device are estimated based on detected, determined, and/or previously known variables, and the position deviation determined by the sensor or the adjustment of the cutting register is corrected by this estimated additional cutting error.

From DE 10 2012 017 636 A1, a method for determining the machine-based need for adjustment of the punching and/or embossing machine is known, comprising the following steps:

a) mathematically dividing the total surface area of a makeready sheet into a plurality of sub-areas, in particular using a uniform grid, b) detecting the position and thickness of adjustment strips and adjustment papers on a makeready sheet, c) repeating step b) for a plurality of makeready sheets used in the punching and/or embossing station, d) calculating the mean value of the thickness of the adjustment strips and adjustment papers in a respective area to determine an adjustment requirement profile.

From DE 10 2005 012 913 A1, printing machines having at least one machine element that can be adjusted by means of a setting element are known, wherein an adjustment of the at least one machine element has an effect on the quality of printing carried out by the printing machine, an optical detection device that includes a sensor oriented toward the surface of a printing substrate being printed in the printing machine detects the quality of the printing, and a control device that receives data from the optical detection device adjusts the at least one machine element by means of the setting element, based on a difference between a specified target value for the quality of the printing and the actual value for the quality of the printing, detected by the optical detection device, in a way that minimizes the difference between the target value and the actual value.

From WO 2003/082 574 A1 a web-fed printing press is known, comprising: at least one flexographic printing module capable of applying variable amounts of motion and tension to a web-format substrate; at least one gravure printing module capable of applying variable amounts of motion and tension to a web-format substrate; and means for controlling the amounts of motion and tension applied by the flexographic printing module and the gravure printing module to the web-format substrate.

From WO 2001/015091 A2, a method and a device for processing copies are known, in which a printed image on a printing substrate that has been printed with multiple copies is inspected by means of an inspection device, and the printing substrate is separated into its individual copies with defective copies being discarded.

From WO 2002/048014 A1, a device for separating copies on a printed sheet and for removing defective copies is known, said device comprising a first cutting device for cutting the sheet that has been printed with a multiplicity of copies into a plurality of longitudinal strips each comprising multiple copies, a quality control device for detecting defective copies, and a second cutting device for cutting the strips into individual copies.

SUMMARY OF THE INVENTION

The object of the present invention is to devise a method for separating printed products that are printed together onto a sheet, in which, even in the event of a printing process-induced, in particular trapezoidal deformation of the sheet, the geometries, e.g. lengths and/or widths, of printed products that are separated from the sheet in question will remain within permissible tolerances despite the deformation of the sheet.

The object is attained according to the invention wherein, for each printed product that has been identified, in terms of its position based on its identification feature, the quality control device detects information relating to an exceeding of the permissible tolerance, at least the length or the width of the printed product. The quality control device transmits this information, detected by it, assigning that information to the position identified on the sheet, to a control unit of the cutting system. Based on the information transmitted by the quality control device, for similar printed products that are arranged on the same position on the sheet and which will be separated subsequently in the cutting system, the control unit of the cutting system adjusts the relevant sheet and the cutting device in their respective positions relative to one another in such a way that each of the printed products to be separated complies optimally with the respective preset tolerance. The optimal compliance with the relevant tolerance is achieved in that the position of the sheet and the cutting device to be adjusted relative to one another is calculated in the control unit using a mathematical optimization method. The sheet containing the printed product to be separated is placed on a cutting table in the cutting system. The control unit of the cutting system adjusts the position of the sheet to be cut, which is lying on the cutting table, in relation to the cutting device of the cutting system, in accordance with the position calculated by the mathematical optimization method.

The advantages to be achieved with the invention consist, in particular, in that even in the event of a printing process-induced, in particular trapezoidal deformation of the sheet, printed products separated from the sheet in question are produced, the geometries of which remain within permissible tolerances despite the deformation of the sheet.

BRIEF DESCRIPTION OF THE DRAWINGS

An exemplary embodiment of the invention is illustrated in the set of drawings and will be described in greater detail below. Further advantages of the invention will also be apparent in conjunction with the exemplary embodiment.

The drawings show.

DESCRIPTION OF THE PREFERRED EMBODIMENT

Figure 1:
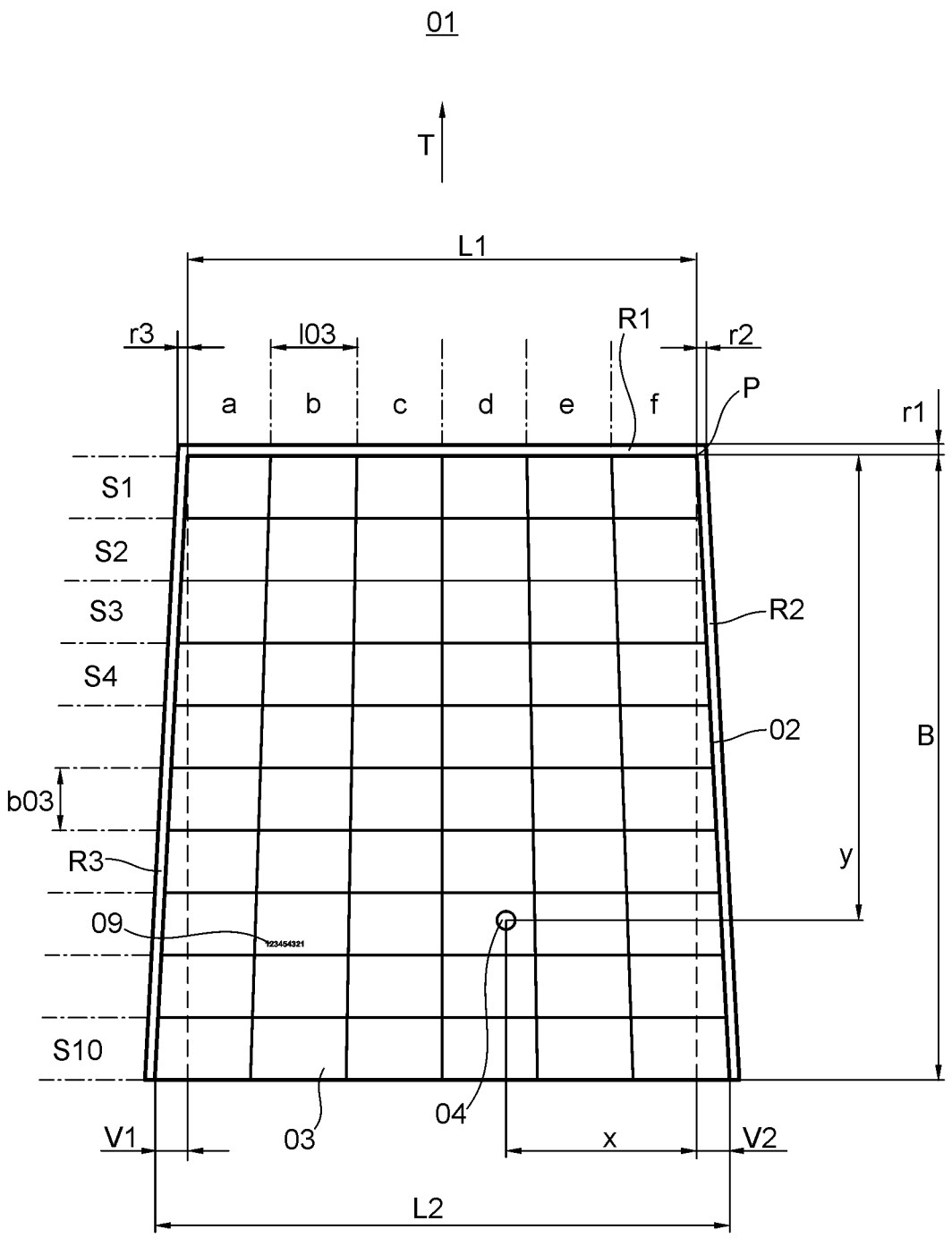
FIG. 1 a sheet deformed by the printing process and printed in multiple-up format.

FIG. 1 shows an example of a single printed sheet, referred to simply as sheet 01. This sheet 01 is preferably made of paper, e.g. a banknote paper, or of cardboard or paperboard. In the unprinted state, this sheet 01 has a rectangular format, with a first edge length ranging from 450 mm to 820 mm, for example, and with a second edge length, transversely to the first, ranging from 475 mm to 700 mm, for example. The sheet 01 here has been imprinted on at least one side, preferably on both sides, with at least one print image 02 by a printing press 06 (FIG. 2) in an industrial printing process, e.g. in a steel engraving process, preferably in an intaglio printing process. The respective print motifs of print images 02 printed onto the front and the back of the same sheet 01 are typically different from one another.

The sheet 01 shown in FIG. 1 has been printed in multiple-up format. The term multiple-up refers to the number of copies of a printed product 03 arranged on the sheet 01, each individual printed product 03 being a banknote to be produced, for example, or some other document, with each such document including at least one characteristic feature 04, in particular a security feature. A security feature is understood in this context as a characteristic property that proves the authenticity of said document and at least makes it considerably more difficult to forge said document. The multiple-up copies are arranged in the print image 02 on the sheet 01 in multiple, e.g. two to eleven, in particular six columns a; b; c; d; e; f and in multiple, e.g. two to ten rows S1; S2; S3; S4; . . . ; S10, in particular three to eight rows S1; S2; S3; . . . . During execution of a specific production process, the sheet 01 in question is transported through the printing press 06 in a specific transport direction T. The arrangement of the multiple-up copies here has the columns a; b; c; d; e; f in this transport direction T. The rows S1; S2; S3; S4; . . . extend transversely to this transport direction T. Each individual printed product 03 should have a width b03 in the transport direction T of the sheet 01 and a length 103 transversely to the transport direction T of the sheet 01. The width b03 of an individual printed product 03 lies within a range of 50 mm to 100 mm, for example, preferably of 58 mm to 90 mm. The length 103 of an individual printed product 03 lies within a range of 100 mm to 200 mm, for example, preferably of 110 mm to 180 mm. All printed products 03 printed together on the sheet 01 should have the same width b03 in the transport direction T of the sheet 01 and the same length 103 transversely to the transport direction T of the sheet 01, within the limits of permissible preset tolerances.

The print image 02 printed onto the originally rectangular sheet 01 has a width B in the transport direction T of the sheet 01 and initially has a first length L1 transversely to the transport direction T; this initial length L1 may change to a different, second length L2 as a result of the printing process. In a steel engraving process in particular, preferably in an intaglio printing process, the sheet 01 is subjected to very high mechanical pressure during the printing process as it passes through the printing press 06, so that the sheet 01, which in its unprinted state is rectangular, and thus also the print image 02 printed thereon, become deformed, in particular trapezoidally. This deformation of the sheet 01 can cause the print image 02, which is actually meant to be rectangular in shape, to become symmetrical with an isosceles trapezoid or even a scalene trapezoid. The trailing end in the transport direction T of the sheet 01 forms the base of this trapezoid. Thus in practice, once the printing process has been carried out, the second length L2 of the print image 02, which corresponds to this base of the trapezoid, is somewhat greater than the actually intended length L1 of the print image 02 found at the leading end of the sheet 01 in the transport direction T of the sheet 01. This increase in length often amounts to more than 0.1% of the original length L1 of the print image 02 and can total, e.g. up to 10 mm; said increase in length is indicated in FIG. 1 by the elongations V1; V2; said elongations V1; V2 may differ from one another in terms of length and each forms a part of the second length L2.

A sheet 01 to be printed must be held during its transport through the printing press 06 by holding means. In practice, grippers are often used as holding means. At least one of these grippers, and preferably at least two grippers arranged spaced apart from one another along the first length L1 of the print image 02, hold the sheet 01 in question at an edge region R1, which is preferably located at the leading edge of this sheet 01 in the transport direction T and is also referred to as the gripper edge R1. The gripper edge R1 extends at the leading edge of the sheet 01 in the transport direction T, which forms a boundary line, and transversely to the transport direction T of this sheet 01, over a width r1 directed in the transport direction T of this sheet 01, the width r1 of the gripper edge R1 ranging from 15 mm to 35 mm, for example. The right and left edges of the sheet 01, each extending lengthwise along the transport direction T of the sheet 01 and each forming a boundary line, also each have an edge region R2; R3 with an associated width r2; r3 oriented transversely to the transport direction T of this sheet 01 in each case. Each of these edge regions R2; R3 is also referred to as a side edge R2; R3. The width r2; r3 of each respective side edge R2; R3 ranges from 5 mm to 30 mm, and the widths r2; r3 of these edge regions R2; R3 may be the same or different. The gripper edge R1 and the two side edges R2; R3 encompass three sides of the print image 02, which is printed onto the sheet 01 and which comprises multiple copies. At the rear edge of the sheet 01 in the transport direction T, which in turn forms a boundary line, an edge region extending lengthwise along the second length L2 of the print image 02 is optionally also provided, with the width of the edge at the trailing end of the sheet 01 ranging from 5 mm to 40 mm, for example.

The individual printed products 03 formed on the sheet 01 in question each have at least one characteristic feature 04, for example, with the position of a relevant characteristic feature 04 arranged in the print image 02 being determined or at least determinable by an assignment of coordinates, preferably Cartesian coordinates x; y, which are established in reference to specified boundary lines, e.g. of the print image 02 or of the printed product 03 in question in each case. In the sheet 01 illustrated by way of example in FIG. 1, the reference point P, i.e. the point of origin for coordinates x; y used for identifying the position of a characteristic feature 04 in at least one of the printed products 03 produced by the print image 02, lies, e.g., in the right corner on the leading side of this print image 02 in the transport direction T of the sheet 01. A deformation, caused by the printing process, of the sheet 01 and of the print image 02 applied to it changes the respective length 103 and/or the respective width b03 of individual printed products 03; particularly in the case of printed products 03 each in the form of a banknote, such a change must not exceed a deviation of, e.g. ±1 mm from the corresponding target values. However, the trapezoidal deformation, in particular, of the sheet 01 and of the print image 02 applied to it also changes the position of the characteristic feature 04 in question relative to the specified boundary lines of the printed product 03 in question in each case. Such a change in the position of the characteristic feature 04 in question, particularly in the case of printed products 03 each in the form of a banknote, must not exceed a deviation of, e.g. ±1 mm from the target position. If these specified permissible preset tolerances are exceeded, the printed products 03 in question, particularly if each product forms a banknote, must be removed as scrap from the ongoing production process and/or destroyed.

The printed products 03 printed in multiple-up format are clearly identifiable in terms of their respective position on the respective sheet 01, because each of these printed products 03 has an identification feature 09. For instance, each of these printed products 03 is furnished, e.g. with a serial number that is sequential within the production process. Additionally, each sheet 01 processed in the production process can preferably be furnished with a sheet number, for example, so that even in a production process that comprises multiple sheets 01, the respective position of each of the printed products 03 printed in said production process can be clearly identified. Alternatively, the numbering scheme that is used, with the sheet numbers contained within a previously defined range and the known number of multiple-up copies, i.e. printed products 03, on each of the sheets 01, can be used to calculate the respective number of each sheet 01.

Figure 2:
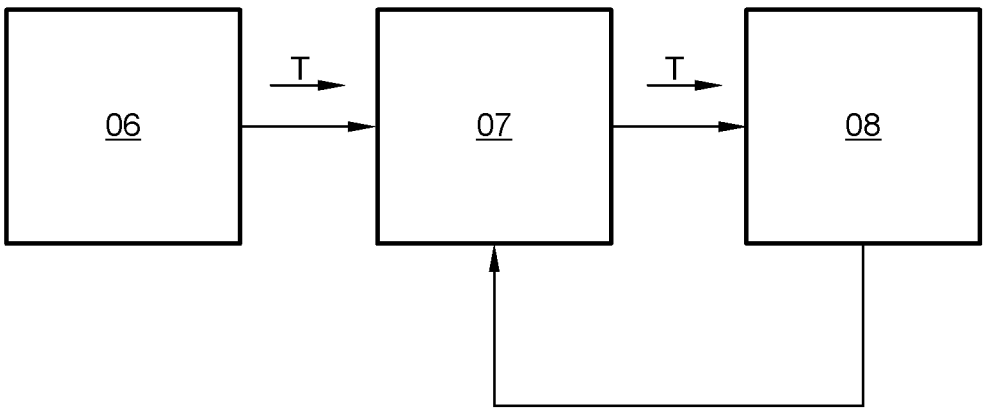
FIG. 2 a schematic diagram illustrating the production of printed products printed in multiple-up format.

In an industrial printing process for producing banknotes carried out using a printing press 06, the aim is to produce at least 100,000 banknotes per hour, preferably up to 600,000 banknotes per hour, for example. To this end, a multiplicity of sheets 01 are printed in succession in the printing press 06, each with the same print image 02. As indicated in FIG. 2, the sheets 01, each of which has been printed with multiple copies, are fed to a cutting system 07 located downstream of the printing press 06 in the production process, where the printed products 03 printed in multiple-up format, each of which forms a banknote, for example, will be separated. The printed products 03 are separated in the cutting system 07 by the performance, e.g. of a sequential series of cuts, each rectilinear, by which the printed sheet 01 in question is cut progressively into multiple strips that correspond to the respective columns a; b; c; d; e; f and/or rows S1; S2; S3; S4; . . . ; S10 of the multiple-up arrangement. The individual cutting lines of these cuts should extend such that the respective length 103 and/or the respective width b03 of individual printed products 03, each of which forms a banknote, for example, and/or the position of the characteristic feature 04 in question relative to the respective target position comply optimally, in terms of a "best fit" adjustment, with the respective specified and/or preset tolerances for the respective printed products 03, and do not exceed these tolerances, despite a printing process-induced deformation of the sheet 01 and of the print image 02 applied to it. The "best fit" adjustment is carried out using a mathematical optimization method. The optimization method may include, for example, computing a mean value from multiple detected or determined individual values, calculating a standard deviation, and/or factoring in a specific quartile (0%, 25%, 50% (=median), 75%, 100%). An equalization calculation or a computational approximation method, for example, can also be used as the mathematical optimization method. Depending on which optimization method is selected, the production process may focus more on the quality of the printed products 03 produced or on the quantity of the printed products 03 to be produced. The "best fit" adjustment can therefore be performed as needed in that, in a given production process, either as many printed products 03 as possible of adequate quality are produced or a comparatively smaller number of printed products 03 of high quality are produced. This decision can be made individually prior to or at the start of production by selecting the appropriate optimization method.

Compliance with the permissible preset tolerances is verified in a quality control device 08 situated downstream of the cutting system 07 in the production flow and is preferably monitored continuously during the relevant production process. The quality control device 08 has, e.g. a preferably optoelectronic, in particular camera-based inspection system and subjects the already produced printed products 03 to individual testing, for example. Information detected by the quality control device 08, in particular with regard to a deviation from at least one of the permissible tolerances, and the position of the printed product 03, identified based on its identification feature 09, that exceeds at least one of the specified tolerances are reported back to the cutting system 07, preferably directly and/or in real time.

Figure 3:
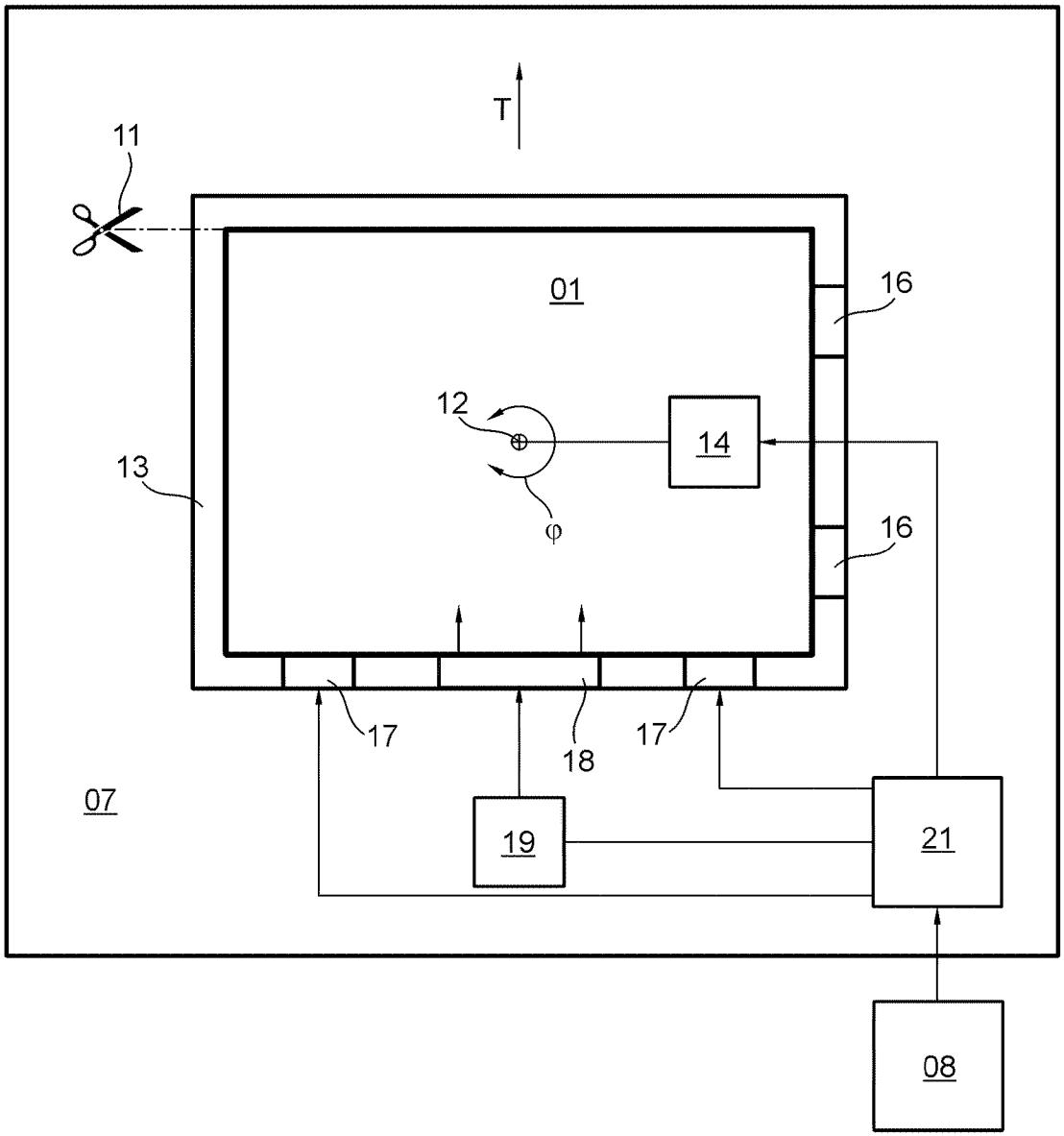
FIG. 3 a cutting system with a cutting device.

As is clear from FIG. 3, the cutting system 07, illustrated only schematically by way of example, in conjunction with at least one cutting device 11, which is arranged fixedly in said cutting system 07 and preferably performs rectilinear cuts, comprises a cutting table 13, which is rotatable within a horizontal plane about a preferably vertical axis 12, for example, and on which cutting table 13 a sheet 01 to be cut into strips is or at least can be placed. The cutting table 13 is preferably rotatable about the axis 12 in both circumferential directions, by an angle of rotation φ indicated by a directional arrow, the rotary motion being driven by a drive 14 controlled by a control unit 21. A sheet 01 to be cut, which is lying on this cutting table 13 in a position defined, e.g. by stops 16, is held there preferably by clamps 17 controlled by the control unit 21 and/or can be displaced on the cutting table 13, in particular in the transport direction T of the sheet 01, by a corresponding actuation of at least one slide 18, which is moved by a drive 19. The information reported back by the quality control device 08 to the control unit 21 of the cutting system 07 is used in particular to control the rotary movement of the cutting table 13 of the cutting system 07 and/or the forward feed over the cutting table 13 of the sheet 01 to be cut, in each case in relation to the cutting device 11, in such a way that the respective length 103 and/or the respective width b03 of individual printed products 03, each of which forms a banknote, for example, and/or the position of the characteristic feature 04 in question in relation to the respective target position comply optimally, e.g. in terms of a "best fit" adjustment, with the respective preset tolerances for the respective printed products 03, despite a printing process-induced, in particular trapezoidal deformation of the sheet 01 and of the print image 02 applied to it; here again, the "best fit" adjustment is carried out using a mathematical optimization method. As mentioned above, the optimization method can be selected as needed according to the production to be carried out.

In light of the problem outlined above, a method is now proposed for separating printed products 03 that are printed together onto a sheet 01, wherein printed products 03 that have been printed together onto the sheet 01 in a printing press 06 are separated in a cutting system 07, located downstream of the printing press 06, by means of a cutting device 11 that performs preferably rectilinear cuts. Each of these printed products 03 has an identification feature 09 that uniquely identifies its respective position on the sheet 01.

The unprinted sheet 01 is rectangular in shape. Since the sheet 01 is deformed, in particular trapezoidally, as it passes through the printing press 06, the separated printed products 03 are likewise deformed as a result of the deformation of the sheet 01. Therefore, in a quality control device 08 downstream of the cutting system 07, the separated printed products 03 are inspected for their compliance with a permissible tolerance, at least with regard to their respective length 103 and/or width b03, wherein for each printed product 03 that is identified with respect to its position based on its identification feature 09, the quality control device 08 detects information relating to an exceeding of the permissible tolerance for at least the length 103 and/or width b03 of the printed product 03 in question. The quality control device 08 transmits this information detected by it, assigning said information to the position on the sheet 01 as determined based on the identification feature 09, to a control unit 21 of the cutting system 07, and, for similar printed products 03 that are arranged in the same position on the sheet and will be subsequently separated in the cutting system 07, the control unit 21 of the cutting system 07 adjusts the respective positions of the sheet 01 in question and the cutting device 11 relative to one another on the basis of the information transmitted by the quality control device 08 in such a way that each of the printed products 03 to be separated complies optimally with the respective preset tolerance, the optimal compliance with the tolerance in question being achieved by calculating the positions of the sheet 01 and of the cutting device 11 to be adjusted relative to one another, in the control unit 21, as discussed above, using a mathematical optimization method. The sheet 01 in question and the cutting device 11 are therefore adjusted in terms of their respective positions relative to one another after the relevant mathematical optimization method has been applied, i.e. according to the position calculated by means of the relevant mathematical optimization method. Thus, the permissible preset tolerance at least for the length 103 and/or width b03 of the printed product 03 in question and/or the permissible preset tolerance for the change in the position of the at least one characteristic feature 04 in question are preferably adjusted in the control unit 21 of the cutting system 07.

Since each individual printed product 03 also has at least one characteristic feature 04 at a specific position in the print image 02 in question, the position of the characteristic feature 04 in question typically also changes as a result of the deformation, in particular caused by the printing process, of the sheet 01 and of the print image 02 applied to it. Therefore, for each printed product 03 that is identified on the basis of its identification feature 09, the quality control device 08 also detects information relating to an exceeding of the permissible tolerance for the change in position of the at least one characteristic feature 04 in question, and the quality control device 08 also transmits this information to the control unit 21 of the cutting system 07 for adjustment of the respective positions of sheet 01 and cutting device 11 relative to one another.

The sheets 01 are preferably printed by the printing press 06 in a steel engraving process or in an intaglio printing process. Each sheet 01 is printed with a print image 02 on one side and/or on both sides. In the preferred embodiment, multiple printed products 03, typically strung together seamlessly in the print image 02, are arranged on each sheet 01 in multiple columns a; b; c; d; e; f extending in the transport direction T of the sheet 01 and in multiple rows S1; S2; S3; S4; . . . extending transversely to the transport direction T of the sheet 01, and, for each of the printed products 03 printed together onto the sheet 01, the same width b03 in the transport direction T of the sheet 01 and the same length 103 transversely to the transport direction T of the sheet 01 and an identification feature 09 clearly identifying the respective position of said printed product on the sheet 01 are prescribed by law or by the client, for example. Each of the individual printed products 03 is in the form of a banknote, for example, and/or each of the printed products 03 is preferably furnished with a serial number that is sequential within the production process as its respective identification feature 09. A camera-based inspection system, in particular, is used as the quality control device 08.

The printed products 03 printed together onto the sheet 01 are separated in a cutting system 07 located downstream of the printing press 06 in the transport direction T of the sheets 01, the cutting system 07 having at least one cutting device 11 and, e.g. a cutting table 13, which is adjustable, at least in terms of its angle of rotation φ, in relation to the cutting device 11 in question. A sheet 01 lying on the cutting table 13 of the cutting system 07 and preferably to be cut into strips is also preferably controlled by the control unit 21 in terms of its forward feed relative to the cutting device 11 in such a way that optimal compliance with the respective specified tolerances by the respective printed products 03 is achieved. Said optimal compliance with the specified tolerances is achieved by calculating an adjustment of the angle of rotation φ of the cutting table 13 and/or an adjustment of the forward feed of the sheet 01 lying on the cutting table 13 of the cutting system 07 and preferably to be cut into strips, in the control unit 21 using a mathematical optimization method.

In an industrial printing process for producing banknotes, carried out in a printing press 06, a multitude of sheets 01 are typically printed and then fed sequentially to the cutting system 07 for separation of the respective printed products 03 from each sheet. The individual printed products 03 are then inspected in the quality control device 08 for compliance with tolerances, as described. In order to prevent individual outliers in the exceeding of a specified tolerance, identified by the control unit 21 of the cutting system 07, from causing an abrupt change in the adjustment of the angle of rotation ci of the cutting table 13 and/or in the adjustment of the forward feed of the sheet 01, which is lying on the cutting table 13 of the cutting system 07, preferably to be cut into strips, it is provided in the preferred embodiment that, for similar printed products 03 that are arranged in the same position on the sheet 01 and will be separated subsequently in the cutting system 07, the setting of the respective positions of sheet 01 and cutting device 11 relative to one another is adjusted only on the basis of repeatedly detected information regarding an exceeding of the permissible tolerance at least for the length 103 and/or width b03 of the printed product 03 in question and/or on the basis of repeatedly detected information regarding an exceeding of the permissible tolerance for the change in the position of the at least one characteristic feature 04 in question. For example, it is provided that a pile of multiple sequential sheets 01, e.g. ten, is evaluated by the control unit 21 of the cutting system 07 and the ascertained deviations from a specified target value are averaged, for example, before the control unit 21 of the cutting system 07 adjusts the setting of the respective positions of sheet 01 and cutting device 11 relative to one another for similar printed products 03 that are arranged at the same position on the sheet 01 and will be subsequently separated in the cutting system 07. In other words, the adjustment is preferably made only if, e.g. the mean value determined in each case exceeds the relevant tolerance. Sheets 01 to be evaluated can also be weighted differently, e.g. the first sheet or sheets 01 of a pile and/or the last sheet or sheets 01 of a pile may be weighted more heavily in the evaluation than, e.g. the middle sheets 01 of the pile in question.

While a preferred embodiment of a method for separating printed products that are printed together onto a sheet, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A method for separating printed products (03) that are printed together onto a sheet (01), wherein printed products (03) that are printed together onto the sheet (01) in a printing press (06) are separated by means of a cutting device (11) in a cutting system (07) located downstream of the printing press (06), wherein each of these printed products (03) has an identification feature (09) that identifies its respective position on the sheet (01), wherein the unprinted sheet (01) is rectangular in shape and becomes deformed as it passes through the printing press (06), characterized in that the separated printed products (03), which are likewise deformed as a result of the deformation of the sheet (01), are inspected in a quality control device (08) located downstream of the cutting system (07) for compliance with a permissible preset tolerance, at least with regard to the respective length (103) and/or width (b03) of said printed products, wherein for each printed product (03) that has been identified in terms of its position based on its identification feature (09), the quality control device (08) detects information relating to an exceeding of the permissible tolerance at least for the length (103) and/or width (b03) of the printed product (03) in question, wherein the quality control device (08) transmits this information detected by it, assigning said information to the position identified on the sheet (01), to a control unit (21) of the cutting system (07), wherein, based on the information transmitted by the quality control device (08), for similar printed products (03) that are arranged in the same position on the sheet (01) and will be separated subsequently in the cutting system (07), the control unit (21) of the cutting system (07) adjusts the relevant sheet (01) and the cutting device (11) in their respective positions relative to one another in such a way that each of the printed products (03) to be separated complies optimally with the respective preset tolerance, wherein the optimal compliance with the relevant tolerance is achieved in that the position of the sheet (01) and the cutting device (11) to be adjusted relative to one another is calculated in the control unit (21) using a mathematical optimization method, wherein the sheet (01) containing the printed products (03) to be separated is placed on a cutting table (13) in the cutting system (07), and wherein the control unit (21) of the cutting system (07) adjusts the position of the sheet (01) to be cut, which is lying on the cutting table (13), in relation to the cutting device (11) of the cutting system (07) in accordance with the position calculated by means of the mathematical optimization method.

2. The method according to claim 1, characterized in that the sheet (01) containing the printed products (03) to be separated is placed in the cutting system (07) onto a cutting table (13) that is adjustable at least in terms of its angle of rotation ((p), the adjustment of the angle of rotation ((p) of the cutting table (13) being calculated using the mathematical optimization method.

3. The method according to claim 1, characterized in that the control unit (21) of the cutting system (07) adjusts the position of the sheet (01) to be cut, which is lying on the cutting table (13), in relation to the cutting device (11) of the cutting system (07) by calculating the adjustment of a forward feed of the sheet (01) using the mathematical optimization method.

4. The method according to claim 1, characterized in that each individual printed product (03) has at least one characteristic feature (04) at a specific position in the print image (02) in question, wherein the deformation of the sheet (01) and of the print image (02) applied to it also changes the position of the characteristic feature (04) in question, wherein, for each printed product (03) that has been identified on the basis of its identification feature (09), the quality control device (08) also detects information relating to an exceeding of the permissible preset tolerance by the change in the position of the at least one characteristic feature (04) in question, and wherein the quality control device (08) also transmits this information to the control unit (21) of the cutting system (07) for adjustment of the respective positions of sheet (01) and cutting device (11) in relation to one another.

5. The method according to claim 1, characterized in that the printing press (06) prints the sheet (01) in a steel engraving process or in an intaglio printing process, and/or in that the printed products (03) are each in the form of a banknote.

6. The method according to claim 1, characterized in that each of the printed products (03) is furnished with a serial number that is sequential within the production process as its respective identification feature (09).

7. The method according to claim 1, characterized in that a camera-based inspection system is used as the quality control device (08).

8. The method according to claim 1, characterized in that an equalization calculation or a computational approximation method is used as the mathematical optimization method.

9. The method according to claim 1, characterized in that the mathematical optimization method includes computing a mean value from multiple recorded or determined individual values and/or calculating a standard deviation and/or factoring in a specific quartile (0%, 25%, 50% (=median), 75%, 100%).

10. The method according to claim 1, characterized in that the sheet (01) is deformed trapezoidally as it passes through the printing press (06).

11. The method according to claim 1, characterized in that, for similar printed products (03) that are arranged in the same position on the sheet (01) and will be subsequently separated in the cutting system (07), the setting of the respective positions of sheet (01) and cutting device (11) in relation to one another is adjusted only on the basis of repeatedly detected information regarding an exceeding of the permissible preset tolerance, at least for the length (103) and/or width (b03) of the printed product (03) in question, and/or on the basis of repeatedly detected information regarding an exceeding of the permissible preset tolerance for the change in the position of the at least one characteristic feature (04) in question.

12. The method according to claim 1, characterized in that a pile of multiple sequential sheets (01) is evaluated by the control unit (21) of the cutting system (07) before the control unit (21) of the cutting system (07) adjusts the setting of the respective positions of sheet (01) and cutting device (11) relative to one another for similar printed products (03) that are arranged at the same position on the sheet (01) and will be separated subsequently in the cutting system (07).

13. The method according to claim 1, characterized in that the choice of mathematical optimization method to be applied establishes whether, in a given production process, a maximum number of printed products (03) of adequate quality will be produced or a comparatively smaller number of high-quality printed products (03) will be produced.

14. The method according to claim 1, characterized in that the permissible preset tolerance at least for the length (103) and/or width (b03) of the printed product (03) in question and/or the permissible preset tolerance for the change in the position of the at least one characteristic feature (04) in question can be adjusted in the control unit (21) of the cutting system (07).

15. The method according to claim 1, characterized in that the printed products (03) printed together as multiple copies on the respective sheet (01) are arranged on each sheet in multiple columns (a; b; c; d; e; f) and in multiple rows (S1; S2; S3; S4; . . . ; S10), and each of the respective printed sheets (01) is cut progressively into multiple strips corresponding to the respective columns (a; b; c; d; e; f) and/or rows (S1; S2; S3; S4; . . . ; S10) of the multiple-up arrangement.

* * * * *